United States Patent [19]

Ito et al.

[11] Patent Number: 4,692,721

[45] Date of Patent: Sep. 8, 1987

[54] DIELECTRIC ROTARY COUPLER

[75] Inventors: Yujiro Ito; Yasutoshi Kamatsu; Takashi Otobe, all of Kanagawa, Japan

[73] Assignee: Sony Corporation, Tokyo, Japan

[21] Appl. No.: 788,726

[22] Filed: Oct. 17, 1985

[30] Foreign Application Priority Data

Oct. 18, 1984 [JP] Japan ..... 59-217371
Oct. 25, 1984 [JP] Japan ..... 59-223003
Apr. 25, 1985 [JP] Japan ..... 60-87483

[51] Int. Cl.[4] ..... H01P 5/08; H01P 5/18; H01P 3/16

[52] U.S. Cl. ..... 333/109; 333/27; 333/111; 333/261; 358/335

[58] Field of Search ..... 333/109, 24 R, 27, 240, 333/261, 111, 113, 115, 116, 136, 137, 1, 239; 346/74.2, 74.5; 358/301, 310, 335; 360/55, 52, 84, 87

[56] References Cited

U.S. PATENT DOCUMENTS 2,794,959 6/1957 Fox ..... 333/113

FOREIGN PATENT DOCUMENTS 0074202 6/1980 Japan ..... 333/111

*Primary Examiner*—Marvin L. Nussbaum
*Attorney, Agent, or Firm*—Hill, Van Santen, Steadman & Simpson

[57] ABSTRACT

A dielectric rotary coupler for electromagnetic waves of the microwave frequency region structured of a substantially ring-shaped rotary member and a stationary member, each member being formed of a dielectric waveguide, or line, having a rectangular cross-section. The rotary line and the stationary line are arranged to face each other with a predetermined space therebetween along a coupling length, through which a microwave, for example, a carrier microwave FM-modulated by a signal reproduced by a rotary head of a VTR, is coupled from the rotary line to the stationary line, or vice versa.

11 Claims, 15 Drawing Figures

DIELECTRIC ROTARY COUPLER

BACKGROUND OF THE INVENTION

1. Field of the Invention

The present invention relates to a coupler employing dielectric lines and more particularly to a dielectric rotary coupler effective in transmitting an electric signal to a rotating member or in receiving an electric signal from a rotating member.

2. Description of the Prior Art

It is known that, where two transmission paths formed of dielectric lines, or waveguides, are disposed closely to each other, if a signal is supplied to one of the dielectric lines, energy of the signal propagated along that dielectric line is coupled into the other dielectric line (refer to Institute of Electronics and Communication Engineers of Japan Technical Research Report: Microwave, Volume 18, No. 93, 1981.7.24, MW8137).

The phenomenon will be described in detail in the following.

In FIG. 5 is shown an example of a line made of a dielectric (relative dielectric constant $\epsilon_1$). The dielectric line in a rectangular section (a, b) is placed in a medium (including air) having a lower relative dielectric constant $\epsilon_2$ than that of the same $\epsilon_1$.

If, now, an electromagnetic wave of the class of a microwave or millimeter wave (in the frequency range between 1 GHz and hundreds GHz), having electric power $P_1$ is input to the dielectric line (hereinafter to be simply called line) 1 from its one end 1*a*, the electromagnetic wave can be confined in the line 1, propagated along the Z axis, and taken out from the side of the terminal 1*b* as power $P_2$.

At that time, even if the dielectric line 1 is bent, the electromagnetic wave travels along the line 1.

The mode of the electromagnetic wave propagating in the line 1 varies with the frequencies of the input signal, the sectional forms and dimensions of the line 1, the relative dielectric constants of the medium $\epsilon_2$ surrounding the line 1 whose relative dielectric constant is $\epsilon_1$, and so forth. When these are set at suitable values, the transverse mode of the electromagnetic wave propagating along the line 1 can be made into a single propagating waveform.

And the propagation wavelength can be set on the order of some centimeters to 0.1 mm.

Now, a coupler formed of such lines will be described in the following.

A second line 2 formed of a dielectric is disposed in parallel with a first line 1 at a distance of $d_1$ as shown in FIG. 6.

When an electromagnetic wave whose power is $P_1$ is input to the first line 1 from its one end 1*a*, it travels along the Z axis as described above. But in the case where the second line 2 is disposed at the position $Z=Z_1$, the electromagnetic wave (shown with fine lines) which has been propagated up to this point begins now to be coupled into the second line 2. This phenomenon of coupling, which depends upon the changes in the propagation mode as will be described later, could be considered to be gradual penetration of the electromagnetic wave traveling along the first line 1 into the second line 2. Power $P_2$ which is coupled into the second line 2 reaches its maximum value at the point $Z=Z_2$ and, as the electromagnetic wave travels further, it is reversely coupled from the second line 2 into the first line 1, and thus the most of the power $P_2$ is returned to the first line 1 at the point $Z=Z_3$.

In this case, $Z_2-Z_1=Z_3-Z_2=L_0$ is designated a coupling length of the dielectric lines.

Such transition of energy of an electromagnetic wave as described above is caused by the difference in phase constants of the propagating wave of an even mode and that of an odd mode.

If it is assumed, for example, that one dielectric line is formed of the first line 1 and the second line 2 as shown in FIG. 7, then two modes, i.e., an even mode wave S and an odd mode wave A, are considered to be traveling in vibrating motion.

Then, the above mentioned coupling length $L_0$ is given by:

$$L_0=\pi/(\beta_{zS}-\beta_{zA}),$$

where $\beta_{zS}$ is the phase constant of the even mode wave S in the direction of the Z axis and $\beta_{zA}$ is the phase constant of the odd mode wave A in the direction of the Z axis.

Now, in order to maximize the electromagnetic energy coupled from the first line 1 into the second line 2, the two lines may be arranged such that the portion overlapping each other becomes the coupling length $L_0$. However, if the second line 2 is bent at a sharp angle at the end of the coupling length $L_0$ or cut off there, the propagation mode of the electromagnetic wave is disturbed at this point and a satisfactory result cannot be obtained.

SUMMARY OF THE INVENTION

Accordingly, it is a primary object of the present invention to provide a good dielectric rotary coupler with one member thereof arranged to be rotatable, in which the above mentioned problem of the prior art is solved.

If the first and second lines 1, 2 are arranged, as shown in FIG. 8, such that their portions disposed in parallel at the distance $d_1$ are from the point $Z=Z_0$ to the point $Z=Z_1$ and their portions gradually deviate from the parallelism after the point $Z=Z_1$, then the phase constants $\beta_{zS}$ and $\beta_{zA}$ also vary after the point $Z=Z_1$. That is, the phase constants $\beta_{zS}$ and $\beta_{zA}$ vary as functions of the distance Z.

Therefore, the total sum of the coupling length 1 from $Z=Z_0$ to $Z=Z_1$ and the coupling length from $Z=Z_1$ to $Z=Z_3$ becomes the actual coupling length L. Since, however, the degree of coupling sharply decreases with the increase in the distance between the two lines, the coupling at the portions to the right of the point $Z=Z_2$ may be neglected, and then, the effective coupling length $\Delta 1$ within the range between the points $Z=Z_1$ and $Z=Z_2$ is given by $$\Delta 1=1/(\beta_{zS}-\beta_{zA})\int_{Z_1}^{Z_2}(\beta_{zS}(Z)-\beta_{zA}(Z))dz,$$

where $\beta_{zS}$, $\beta_{zA}$ are phase constants within the range from $Z=Z_0$ to $Z=Z_1$.

Thus, in the case of FIG. 8, the effective coupling length becomes $L=1+\Delta 1$, and the maximum coupling effect is provided when this effective coupling length agrees with the above mentioned coupling length $L_0$.

According to the present invention, a dielectric rotary coupler is provided utilizing the above described effective coupling length for coupling a signal between a rotating member and a stationary member. That is, one member of the dielectric lines is made into a ring shape and disposed on the rotating side or the stationary side and the other member of the dielectric lines is disposed adjacent to the ring shaped dielectric line.

Since one member of the dielectric lines is arranged in a substantially ring-shaped design, transmission and reception of signals between the stationary member and the rotary member are made possible at most rotating positions of the rotary member, and setting of the optimum coupling length according to the frequency of the carrier wave of the signal and so on is made possible.

Besides, since coupling of signals in the higher frequency region is enabled, high density signal coupling that is unattainable by a rotary transformer or the like can be effectively performed.

BRIEF DESCRIPTION OF THE PREFERRED EMBODIMENT

FIG. 1 is a schematic diagram showing a dielectric rotary coupler of an embodiment of the invention;

FIGS. 2, 3, and 4 are drawings for showing forms of stationary lines and rotary lines in other embodiments of the invention;

Figure 1:
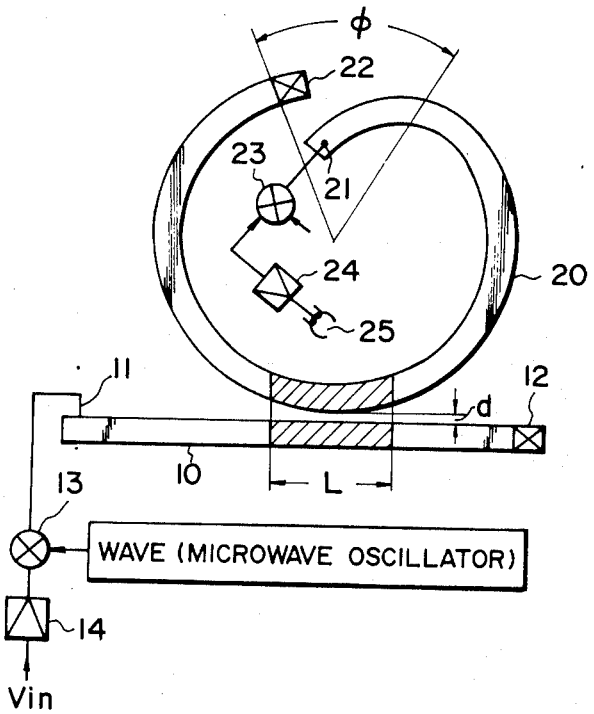
Figure 14:
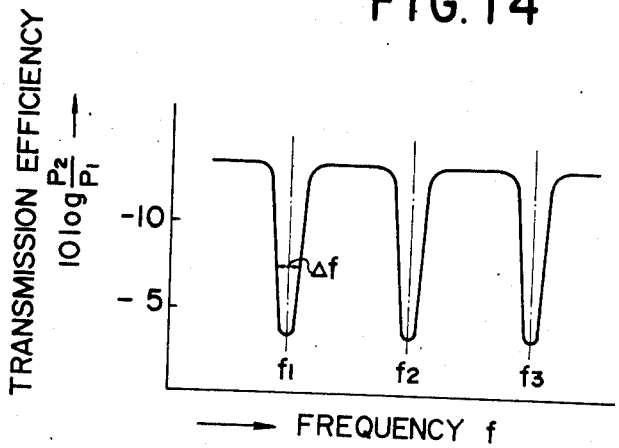
Figure 15:
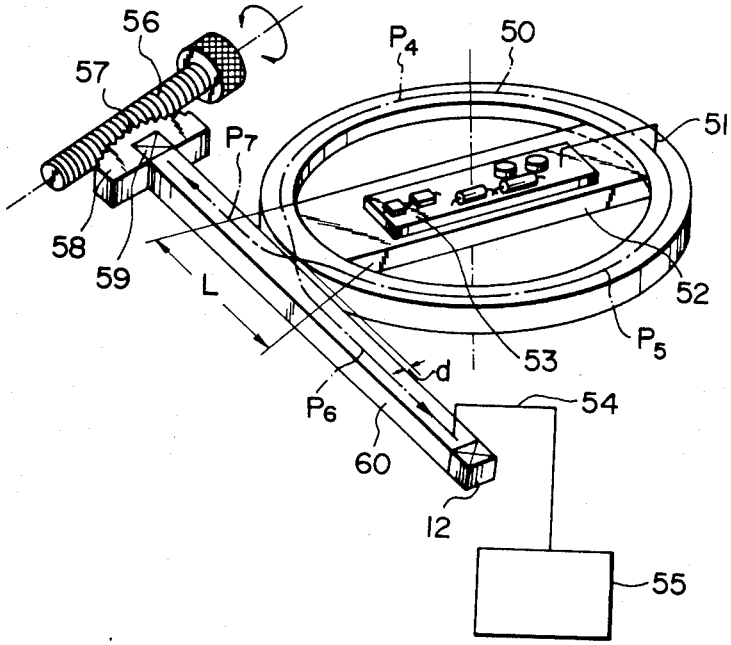

FIGS. 9, 10, 11, 12, and 13 are drawings showing other embodiments;

FIG. 14 is a drawing for explanation about the embodiment of FIG. 1; and FIG. 15 is a perspective view showing an embodiment.

DESCRIPTION OF THE PREFERRED EMBODIMENT

FIG. 1 is a drawing showing a dielectric rotary coupler of a preferred embodiment of the present invention, in which 10 denotes a dielectric line (stationary line) arranged on the stationary side, such as a mechanical chassis, 20 denotes a ring-shaped dielectric line (rotary line) arranged on a rotary member, such as the rotary drum of a magnetic recording and reproducing apparatus.

On one end of the stationary line 10, there is set up an antenna 11 for putting a signal into the line, and the other end of the line is arranged into a nonreflective end 12, which is formed, for example, of an electromagnetic wave absorbing material having the same dielectric constant as the dielectric line. And a signal $V_{in}$, for example, a high density video signal, is supplied to the line through an amplifier 14 and a modulator 13.

The rotary line 20 is likewise provided with an antenna 21 for taking out the signal and a nonreflective end 22, and it is adapted such that the signal is supplied to a rotary head 25 via a demodulator 23 and an amplifier 24.

Incidentally, at the time of reproduction, such a circuit configuration becomes necessary that enables a signal to be output from the rotary line 20 and received by the stationary line 10, but both reproducing and recording by a single structure can be easily attained by providing another modulator and another demodulator on the rotary line side and the stationary line side, respectively, and by providing means for properly switching between the reproducing and the recording functions.

The rotary line 20 and the stationary line 10 are arranged to face each other with a space of d therebetween, wherein the effective coupling length L between both members is arranged so as to become the above mentioned coupling length $L_0$ which provides the maximum degree of coupling.

The effective coupling length L varies with such values as the frequencies of the microwave (millimeter wave) to be modulated by the signal, shapes of the lines, and dielectric constants. Therefore, in order to provide the best coupled condition in the present case, it is preferred to make the frequencies of the microwave to be modulated by the signal adjustable.

In the dielectric rotary coupler of the present invention structured as above, a microwave (millimeter wave) modulated by a video signal, for example, is supplied to the stationary line 10 from the antenna 11 and propagated toward the nonreflective end 12, but the most portion of the electromagnetic wave is transited to the side of the rotating rotary line 20 in its way within the range of the effective coupling length L with the rotary line 20.

The electromagnetic wave transited to the side of the rotary line 20 is supplied through the antenna 21 to the demodulator 23, and after being demodulated by the same, applied to the rotary head 25 through the amplifier 24.

In the above case, a good coupling condition is not provided within the range of the angle $\phi$ corresponding to the portion between the both cut ends of the rotary line 20, but this problem is solved in the case of a television signal by arranging the above described non-coupled period to be put in synchronism with the non-contact period of the tape wrapped around the rotary drum with the rotary head 25.

The present dielectric rotary coupler can, as stated above, be used in the rotary drum the same as the rotary transformer hitherto in use.

In the case of the rotary transformer when applied to the above purpose, however, the transmitted frequencies are only from some MHz to tens of MHz. By contrast, the present dielectric rotary coupler has made it possible to supply a rotary drum with signals of hundreds of MHz of frequency bendwidth and thus such a merit is provided that a television signal of high resolution or high density data can be supplied to the rotary head.

It also provides such a merit that a plurality of signals can be supplied by means of a single dielectric rotary coupler through the technique of frequency multiplexing.

Figure 2:
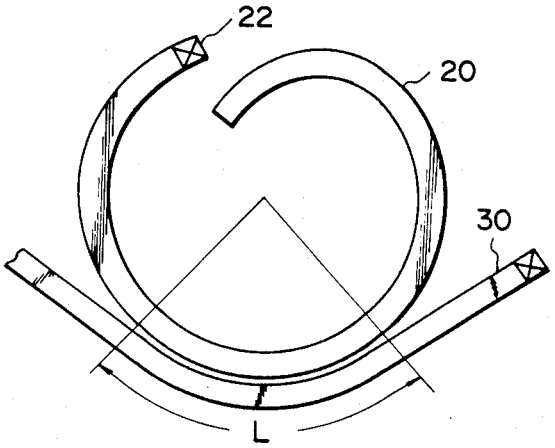

FIG. 2 is a drawing showing a dielectric rotary coupler of another embodiment of the invention, in which 20 denotes a rotary line and 30 denotes a stationary line, and the signal transmitting and receiving circuits are omitted here.

In this embodiment, a bent portion is formed on the side of the stationary line 30 to make the effective length L larger. This arrangement provides a merit specifically when the rotary member is of a small size since a sufficiently large coupling length $L_0$ is provided even in such a case.

Figure 3:
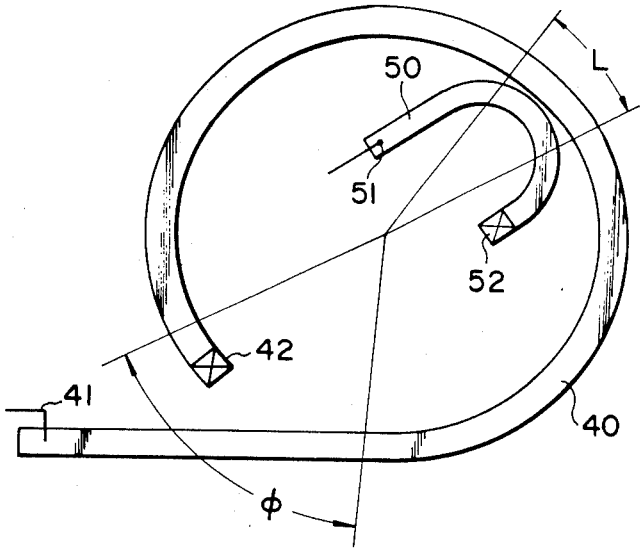

FIG. 3 is a drawing showing still another embodiment of the invention, in which the ring-shaped member is a stationary line 40 and a smaller bent member is a rotary line 50.

In the drawing, 41 and 51 denote antennas for receiving and transmitting a signal, respectively and 42 and 52 denote nonreflective ends.

The present embodiment with the ring-shaped stationary line 40 adapted to be installed on the stationary side, for example, on a chassis, and with the smaller-sized rotary line 50 adapted to be installed on the rotary head on the rotating side is specifically effective when applied to the case where the portion on the rotating side is very small.

Figure 4:
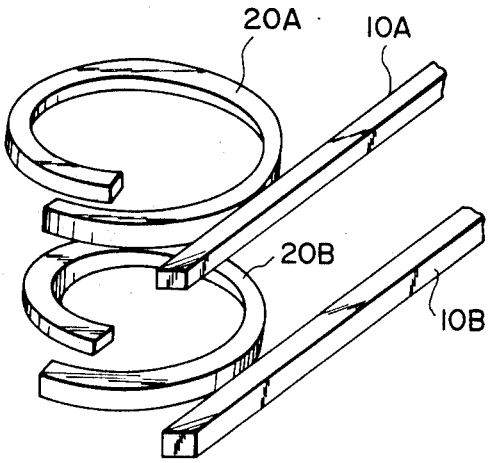
Figure 5:
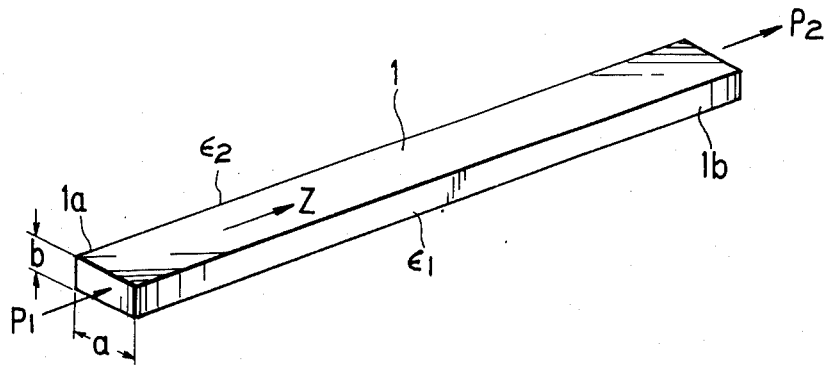
FIG. 5 is a perspective view showing an example of a dielectric line.
Figure 6:
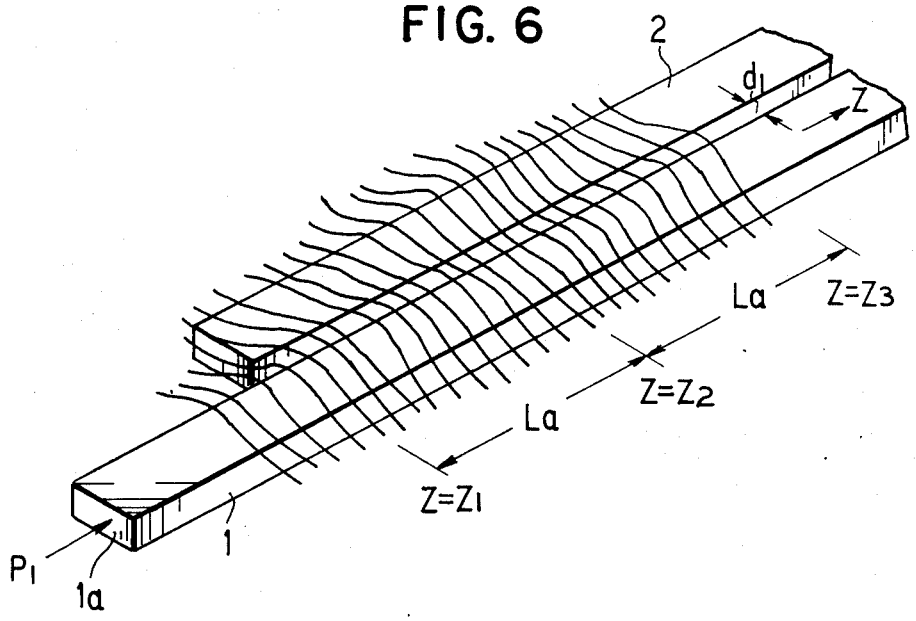
FIG. 6 is an explanatory drawing about propagation mode.
Figure 7:
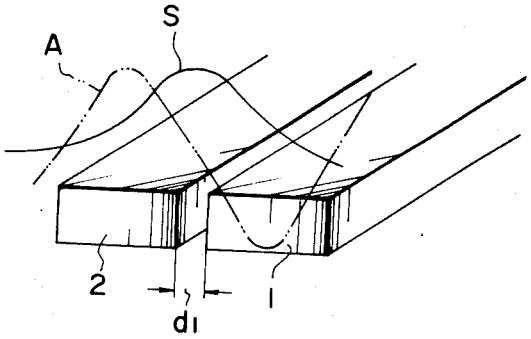
FIG. 7 is an explanatory drawing about even mode and odd mode.
Figure 8:
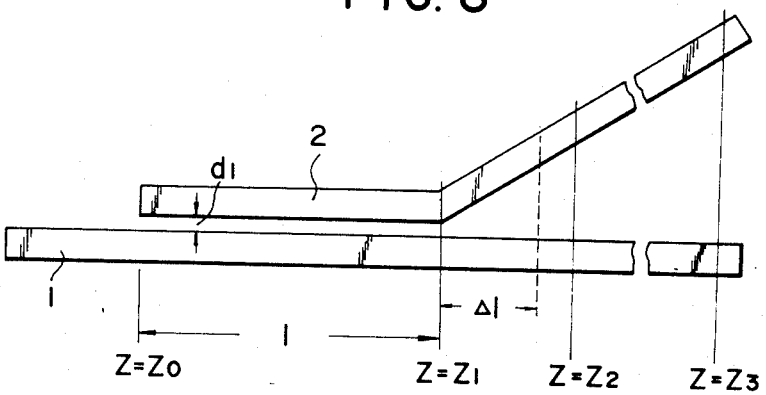
FIG. 8 is an explanatory drawing about coupling length.

FIG. 4 indicates a further embodiment of the invention, in which two sets each of rotary lines 20*a*, 20B and stationary lines 10A, 10B are provided on the rotating side and the stationary side, respectively, lined up in the direction of the rotating shaft. By the described arrangement, transmission and receipt of two systems of signals are made possible, and this arrangement is specifically effective when applied to the couplers used in an apparatus of the helical scan system in which two magnetic heads are used.

In this arrangement, it is preferable in order to suppress a crosstalk to keep the upper and lower dielectric rotary couplers separated with at least a larger space therebetween than the space between the coupled lines and it is also preferable to interpose a shield plate or the like to improve isolation therebetween.

With the above design, it is also possible to arrange the non-coupled portions (the above mentioned portion defined by the angle $\phi$) of the rotary lines 20A, 20B to be disposed at intervals of 180° therebetween so that coupling of a signal is effected between the lines of either of the couplers in any moment, whereby the period during which transmission of the signal is disabled is eliminated at the time of transmission or receipt of the signal.

Still further embodiments in which the transmission disabled period is eliminated without employing the above mentioned cascade structure will be described in the following with reference to the accompanying drawings.

Figure 9:
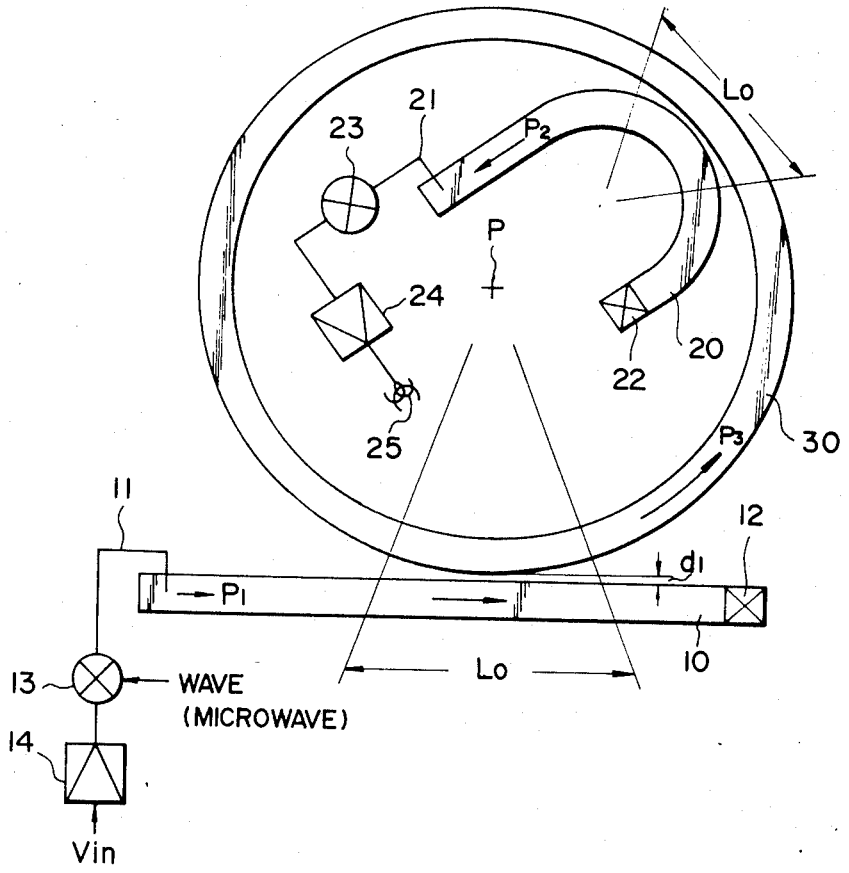

FIG. 9 is a schematic diagram showing a dielectric rotary coupler of one of such embodiments of the invention, in which 10 denotes a first line on the stationary side formed of a substantially straight dielectric member. On one end of the first line 10 is set up an antenna 11 and the other end is formed into a nonreflective end 12. A video signal, $V_{in}$, for example, is supplied through the amplifier 14 to the modulator 13, where the signal is FM-modulated by a microwave (millimeter wave), for example, and input to the line from the antenna 11.

Reference numeral 20 denotes a second line which is installed on a rotary member (not shown) and provided with an antenna 21 and a nonreflective end 22 on its both ends similarly to the first line 10.

In the case where the rotary member is formed of a rotary head of a VTR, a signal is applied to the rotary head 25 by way of the demodulator 23 and the amplifier 24.

Denoted by reference numeral 30 is a ring-shaped third line, which is placed adjacent to both the first and the second lines 10, 20, and, arranged, specifically, concentric with the second line 20 with respect to its center of rotation P.

In the dielectric rotary coupler as described above, if an electromagnetic wave of $P_1$ in its power is input to the first line 10 from the antenna 11, the electromagnetic wave is propagated toward the nonreflective end 12 as described in the foregoing, but couples, in the way, into the ring-shaped third line 30 along the coupling length $L_O$, and, further, coupled into the second line 20 rotating close to the third line 30. In this case, since the third line 30 is ring-shaped, the same oscillates at a resonant condition given by the following formula:

$$2\pi R = n\lambda g,$$

where R is the radius of the third line 30, $\mu g$ is the propagation wavelength, and n is an integer.

Therefore, if the frequency of the power $P_1$ input from the antenna 11 varies, the power $P_2$ coupled thereby varies with the variations in the frequencies, that is, the maximum values of power are coupled from the first line 10 into the second line 20 at the resonant points $f_1$, $f_2$, and $f_3$, for example.

The coupling frequency bandwidth $\Delta f$ (the width at the point where the transmission efficiency is less than the peak value by 3 dB) depends on the dielectric loss, tan $\delta$, of the dielectric line, namely, the smaller the value of tan $\delta$, the narrower the width of the coupling frequency band $\Delta f$. Therefore, in order to broaden the width of the coupling frequency band $\Delta f$, it is better to make the value of tan $\delta$ larger within the limit of the dielectric loss allowed.

Although the third line 30 in a ring shape has been provided on the stationary side, for example, on the chassis in the above description, the third line 30 can be installed together with the second line 20 on the rotary member (rotary head).

Naturally, the above described arrangement can likewise be applied to the case where a signal is supplied by the second line 20 to the first line 10.

Now, the embodiments in which the embodiment of FIG. 9 is further modified will be described with reference to the accompanying drawings.

Figure 10:
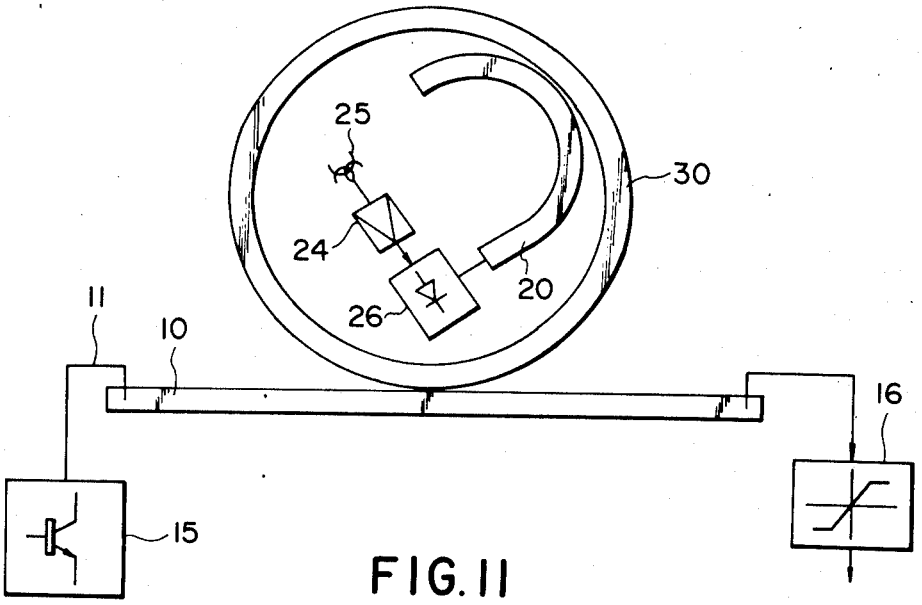

A dielectric rotary coupler of a further embodiment of the invention is shown in FIG. 10, wherein like reference numerals to those in FIG. 9 designate like parts. Reference numeral 15 denotes an oscillating circuit connected to the first line 10, and the oscillating circuit 15 is adapted to oscillate at the resonant frequency of the ring-shaped third line 30 coupled with the first line 10. Reference numeral 16 denotes a demodulator circuit for FM-modulated waves. The second circuit 20 provided on the rotary member side is connected with a variable impedance circuit 26 formed of a varicap (variable-capacitance diode) or the like, and the variable-capacitance circuit 26 is adapted to be supplied with the reproduction signal from the rotary head 25 through the amplifier 24.

In the dielectric rotary coupler as described above, while the oscillating circuit 15 is oscillating at the frequency corresponding to the resonant frequency of the third circuit 30, the resonant frequency present in the third circuit 30 coupled with the second circuit 20 will be varied, or modulated, as a result of change in the capacitance of variable impedance circuit 26 in response to the signal from the rotating side, i.e., the signal reproduced by the rotary head 25. Therefore, the oscillating circuit 15 will be FM-modulated by the reproduction signal from the rotary head 25, and thus, the reproduction signal by the rotary head 25 will be output from the demodulator circuit 16 in connection with the first line 10.

Figure 11:
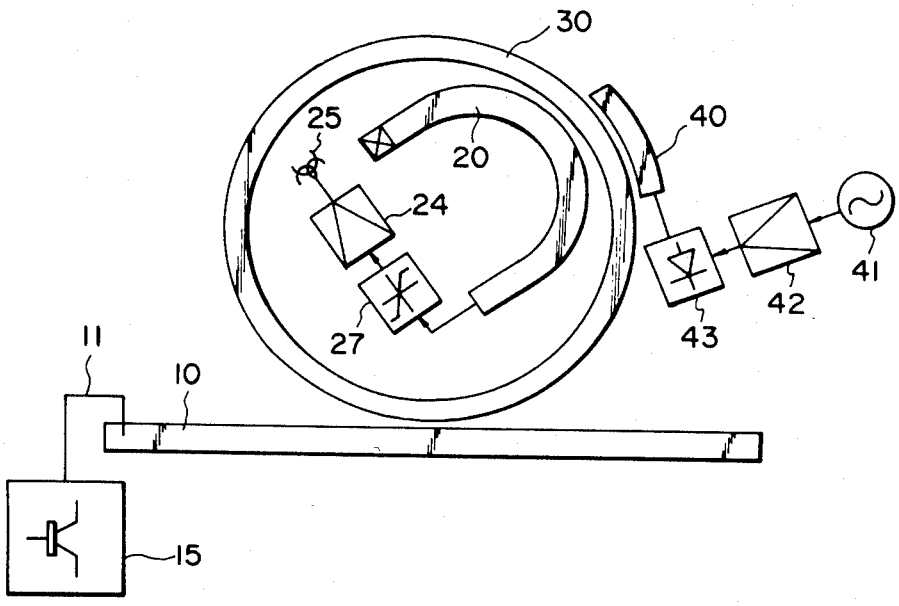

A dielectric rotary coupler of an embodiment for the case where a record signal is supplied to the rotary head 25 is indicated in FIG. 11, in which like reference numerals to those in FIG. 10 denote like parts.

Reference numeral 27 denotes a demodulator circuit provided on the rotating side and 40 denotes a fourth line provided on the stationary side coupled with the third circuit 30, and the fourth circuit 40 is connected with a variable impedance circuit 43 whose impedance is varied by the signal from the record signal source 41 supplied by an amplifier 42.

In the present embodiment, like in the case of FIG. 10, the oscillating circuit 15 oscillates at the resonant frequency of the third line 30, but the third line 30 is coupled with the fourth line 40 and adapted such that the resonant frequency is modulated by the record signal.

Thus, the carrier wave FM-modulated by the record signal is coupled into the second line 20 on the rotary side and demodulated by the demodulator circuit 27, whereby the record signal supplied from the stationary side is detected and this signal is supplied to the recording head 25.

In both the embodiments of FIG. 10 and FIG. 11, the frequencies coupled between the first and second lines 10, 20 are always the same as the resonant frequency of the third line 30, and therefore, these embodiments have such a feature that they are, different from the case of the embodiment of FIG. 9, not limited in the frequency bandwidth, and therefore, the transmission frequency bandwidth can be made broader.

Although FIG. 10 and FIG. 11 have shown the case where a signal is output from the rotary head 25 and the case where a signal is input to the rotary head 25, respectively, it is naturally possible to provide a circuit arrangement capable of both transmitting a signal to and receiving a signal from a recording head 25 by installing both demodulator circuit 27 and the variable impedance circuit 26 on the rotary side and adapting these parts to be switchable by means of a switching circuit.

Figure 12:
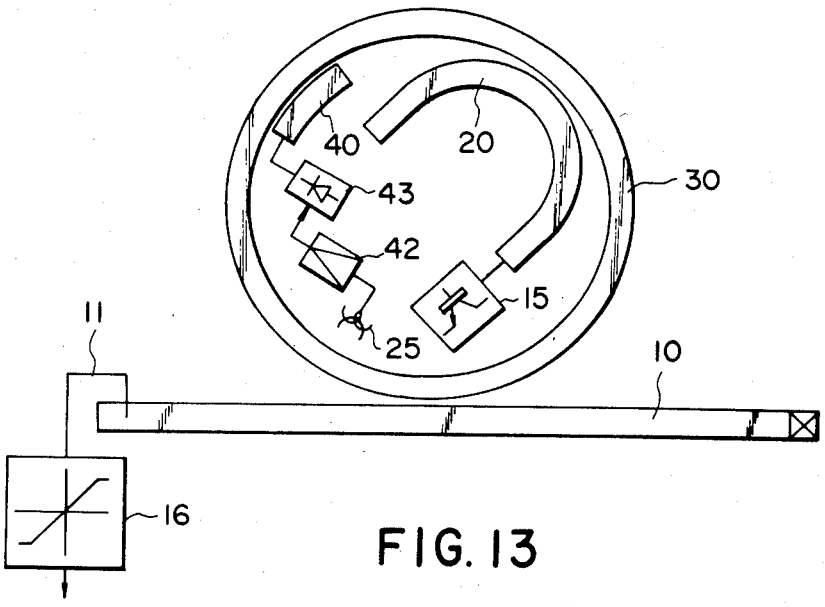
Figure 13:
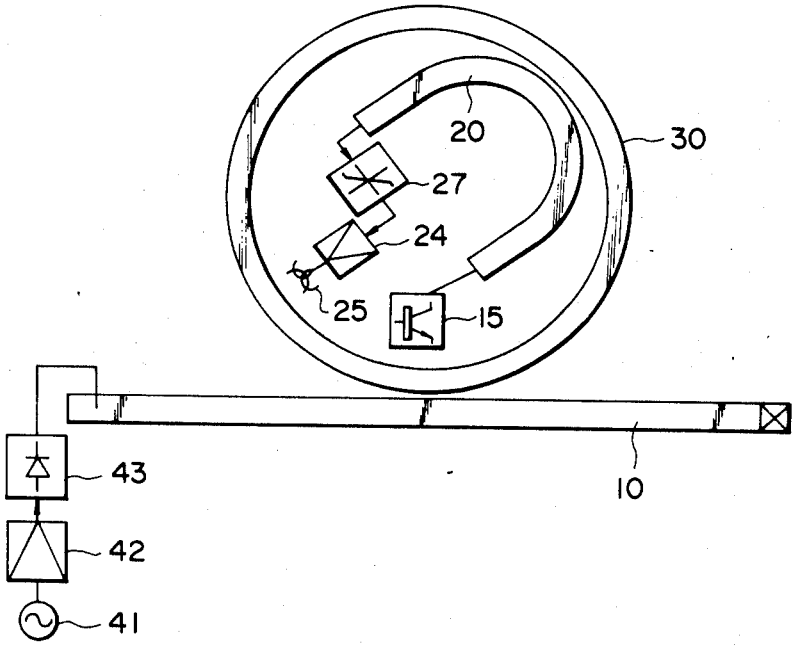

FIGS. 12 and 13 indicate other embodiments of the invention, in which an oscillating circuit 15 is attached to the second line 20 provided on the rotary side, while like parts to those in FIGS. 10 and 11 are denoted by like reference numerals.

Although detailed description is omitted here, the third line 30 is also used in these embodiments as a resonator element, and the signal from the oscillating circuit 15 which is FM-modulated by the reproduced or recording signal provides the frequency to be coupled between the rotary member and the stationary member. Therefore, the advantage is provided that the coupled frequency bandwidth ($\Delta f$) can be made broader.

A further preferred embodiment will be described in the following with reference to FIG. 15 showing the embodiment, in which 50 denotes the ring-shaped first dielectric line on the rotary side, and 60 denotes the second dielectric line on the stationary side separated from the above first dielectric line 50 with the space d therebetween.

Reference numeral 51 denotes the antenna set up on the first dielectric line, 52 denotes a supporting plate for fixing the first dielectric line 50 on the rotary member such as a rotary drum of a VTR, and 53 denotes and electronic circuit (hybrid IC circuit) for amplifying and demodulating the signal reproduced by such means as a rotary head (not shown).

Reference numeral 54 denotes the antenna set up on one end of the second dielectric line 60, and the output of the antenna 54 is supplied in a matched state to an electronic circuit 55 including a demodulator, amplifier, and so on. Numerals 59 and 12 denote nonreflective ends, 58 denotes a supporting piece fixedly attached to the second dielectric line 60, and the other end of the supporting piece 58 is provided thereon with teeth 57 to engage an adjustment screw 56.

In the case where the dielectric rotary coupler as described above is applied to a rotary head of a VTR, a signal provided by the rotary head is, for example, demodulated by a microwave (millimeter wave) in the electronic circuit 53 and supplied to the antenna 51. Then, most portion of the electromagnetic wave of $P_4$ in its power propagating in the counterclockwise direction is coupled into the second dielectric line 60 within the range of the above described effective coupling length L and taken out as power $P_6$ through the antenna 54. Likewise, the electromagnetic wave of $P_5$ in its power propagating in the clockwise direction is coupled into the second dielectric line 60 within the range of the effective coupling length L, but in this case, the coupled wave propagates as indicated by the notation "$P_7$" toward the nonreflective end 59 to be absorbed thereby. Incidentally, portions of the electromagnetic waves which are not coupled into the second dielectric line within the range of the effective coupling length L may make another turn through the first dielectric line 50 to interfere each other causing a resonance phenomenon, and so, it is desirable that the degree of coupling between the first dielectric line 50 and the second dielectric line 60 is made as strong as possible.

It is preferable that tan $\delta$ of of the material forming the first dielectric line 50 is made as large as possible within the limit of the dielectric loss allowed thereby suppress the resonance Q characteristic. The suppressing of the resonance Q characteristic is effective also in broadening the coupling frequency bandwidth.

When supplying power from the stationary member to the rotary member, a microwave signal modulated by the electronic circuit 55 is supplied to the antenna 54. Then, the power can be supplied to the antenna 51 on the side of the rotary member taking the route opposite to that described above. The nonreflective ends 59, 12 are not necessarily needed if the effect of the reflection is small.

The space d between the first and second dielectric lines can be adjusted by means of the adjustment screw 56, whereby the effective coupling length L can be set so that an optimum degree of coupling is provided.

In the embodiment of FIG. 1, the coupling length $L_0$ is calculated to be approximately 20 mm when it is assumed that the relative dielectric constant of the dielectric line $\epsilon_1$ is 10 (e.g. alumina), the carrier frequency is 200 GHz, the width of the line is 2 mm, and the space between the lines is about 0.4 mm, and then the coupling factor of $-6$ dB is attained.

Therefore, the dielectric rotary coupler is specifically effective when used for the rotary coupling transformer in the high density recording and reproducing VTR.

The same, however, is also applicable to such cases that supplies high density information to a rotating member or takes such information out of a rotating member, that is, for example, to a transmission and reception antenna for a radar.

As described so far, the present dielectric rotary coupler can use microwaves or millimeter waves for the signals to be transmitted, and so, high frequency signals that have not been treatable by conventional rotary transformers are made possible to be coupled into a rotating member.

Besides, since the frequency region of the transmitted signals is so large as extending from 0 to hundreds of MHz, there is such an advantage that very high density signals can be transmitted.

It is a matter of course that the above described dielectric lines include such a dielectric image line formed of a metallic material with a dielectric line material placed thereon.

We claim:

1. In a rotary coupler for transmitting signals between signal treatment portions installed on a rotary member and a stationary member, a dielectric rotary coupler comprising a first dielectric line installed on said rotary member, a second dielectric line installed on said stationary member, a first signal input and/or output portion installed on said first dielectric line, a second input and/or output portion installed on said second dielectric line, and means for attaining a coupling between said first and second dielectric lines, one of said first and second dielectric lines being substantially ring-shaped with a center which is coincident with the axis of the rotation of said rotary member, wherein said rotary member rotates during the signal transmission between said first and second input and/or output portions.

2. A dielectric rotary coupler according to claim 1, wherein said means for coupling is provided by disposing said first and second lines close to each other with a predetermined space therebetween.

3. A dielectric rotary coupler according to claim 2, wherein said substantially ring-shaped dielectric line is provided in a portion thereof with a signal transmission disconnecting portion and said substantially ring-shaped line is provided with a nonreflective end at one and thereof and with said signal input and/or output portion at the other end thereof.

4. A dielectric rotary coupler according to claim 3, wherein said substantially ring-shaped line is physically disconnected at said signal transmission disconnecting portion.

5. A dielectric rotary coupler according to claim 3, wherein said dielectric rotary coupler further comprises another pair of dielectric lines installed on said rotary member and stationary member, said two pairs of lines being arranged in a cascade manner in the direction along the axis of rotation of said rotary member, and said signal transmission disconnecting portions in each pair being substantially disposed at intervals of 180°.

6. A dielectric rotary coupler according to claim 2, wherein said substantially ring-shaped dielectric line is of a closed ring shape.

7. (amended) A dielectric rotary coupler according to claim 1, wherein said rotary member is a rotary drum of a VTR and said first dielectric line rotates with said drum and wherein said stationary member is the fixed housing of the VTR and said second dielectric line is fixed thereto.

8. A dielectric rotary coupler according to claim 1, wherein said dielectric rotary coupler further comprises a third dielectric line of a closed ring shape disposed close to each of said first and second dielectric lines with a predetermined space therebetween, and wherein said means for coupling between said first and second dielectric lines is provided by a coupling between said first and third dielectric lines and a coupling between said second and third dielectric.

9. A dielectric rotary coupler according to claim 8, wherein said substantially ring-shaped dielectric line is provided in a portion thereof with a signal transmission disconnecting portion and said substantially ring-shaped dielectric line is provided with a nonreflective end at one end thereof and with said signal input and/or output portion at the other end thereof.

10. A dielectric rotary coupler according to claim 9, wherein said substantially ring-shaped dielectric line is physically disconnected at said signal transmission disconnecting portion.

11. A dielectric rotary coupler according to claim 8, wherein an oscillator oscillating at the resonant frequency of said third dielectric line is connected with one of said first line and second dielectric line, and wherein a variable impedance circuit adapted to be modulated by a transmitted signal is connected with the other of said first dielectric line and second line or with a fourth line which is coupled with said third dielectric line.

* * * * *